United States Patent [19]

Panagin

[11] Patent Number: 5,024,165

[45] Date of Patent: Jun. 18, 1991

[54] SELF-STEERING BOGIE FOR A RAILWAY VEHICLE

[75] Inventor: Romano Panagin, Turin, Italy

[73] Assignee: Fiat Ferroviaria S.p.A., Turin, Italy

[21] Appl. No.: 419,675

[22] Filed: Oct. 11, 1989

[30] Foreign Application Priority Data

Oct. 14, 1988 [IT] Italy ..... 67921 A/88

[51] Int. Cl.[5] ..... B61F 5/44

[52] U.S. Cl. ..... 105/168; 105/165

[58] Field of Search ..... 105/4.4, 165, 167, 168

[56] References Cited

U.S. PATENT DOCUMENTS

| | | | |
|---|---|---|---|
| 2,641,499 | 6/1953 | Gassner | 105/4.4 X |
| 2,746,398 | 5/1956 | Toms | 105/4.4 |
| 3,974,779 | 8/1976 | Lindblom et al. | 105/165 X |
| 4,289,075 | 9/1981 | Smith | 105/4.4 |
| 4,519,329 | 5/1985 | Vacher | 105/168 |
| 4,640,198 | 2/1987 | Häupl | 105/168 |

FOREIGN PATENT DOCUMENTS

| | | |
|---|---|---|
| 177460 | 4/1986 | European Pat. Off. . |
| 837711 | 5/1952 | Fed. Rep. of Germany . |
| 850623 | 9/1952 | Fed. Rep. of Germany . |
| 917308 | 8/1954 | Fed. Rep. of Germany . |

*Primary Examiner*—Robert J. Oberleitner
*Assistant Examiner*—Alfred Muratori
*Attorney, Agent, or Firm*—Klauber & Jackson

[57] ABSTRACT

An independent wheel bogie for a railway vehicle comprising a central support structure, four independent arms carrying respective axles of the wheels and articulated to the support structure by resilient bushes, a suspension device for suspending a vehicle body, a center casting fixed to the support structure with the possibility of relative rotation about its vertical axis and adapted to be rigidly fixed to the vehicle body, and a steering control device for the axles comprising a pair of screw and nut linear actuators disposed longitudinally along the sides of the support structure and connected at their ends to the articulated arms on the corresponding side of the structure, and lever mechanisms for actuation of the linear actuators, activatable by a relative rotation between the bogie and the vehicle body.

10 Claims, 4 Drawing Sheets

SELF-STEERING BOGIE FOR A RAILWAY VEHICLE

BACKGROUND OF THE INVENTION

The present invention relates to a bogie for a railway vehicle, and in particular to a bogie having independent wheels.

Bogies of the said type are known, which substantially comprise:

a central support structure;

four independent arms carrying respective axles of the wheels and articulated to the support structure by means of resilient bushes;

suspension means for a body of the vehicle; and a centre casting fixed slidably to the support structure with the possibility of relative rotation with respect thereto about its vertical axis, and adapted to be rigidly fixed to the vehicle body.

Bogies of the type briefly described have a modest self-steering capacity due to the deformability of the resilient bushes by means of which the arms are articulated to the support structure. The action of the forces exchanged between the wheels and rails in a curve is not, however, sufficient to cause a complete self-steering action, that is to say the axles of the wheels are not disposed in perfectly radial positions with respect to the curve of the track; this results in considerable wear on the wheels and the rails.

SUMMARY OF THE INVENTION

The object of the present invention is the provision of an independent wheel bogie, which will be free from the said disadvantages of known bogies.

The said object is achieved by the present invention in that it relates to an independent wheel bogie for a railway vehicle, of the type comprising:

a central support structure;

four independent arms carrying respective axles of the wheels and articulated to the said support structure two on one side and two on an opposite side by means of respective resilient bushes having horizontal axes extending transversely with respect to the said bogie;

suspension means for a body of the said vehicle;

a centre casting fixed to the said support structure with the possibility of relative rotation about its vertical axis and adapted to be fixed rigidly to the said body; and a device for controlling steering of the said axles; characterised by the fact that the said control device includes at least one pair of linear actuators disposed longitudinally along the sides of the said support structure and connected at their ends to the said articulated arms on the corresponding side of the said support structure, and means for actuating the said linear actuators, activatable by a relative rotation between the said bogie and the said body.

BRIEF DESCRIPTION OF THE DRAWINGS

For a better understanding of the present invention a preferred embodiment thereof will be described hereinbelow purely by way of non-limitative example and with reference to the attached drawings, in which.

DETAILED DESCRIPTION OF THE INVENTION

Figure 1:
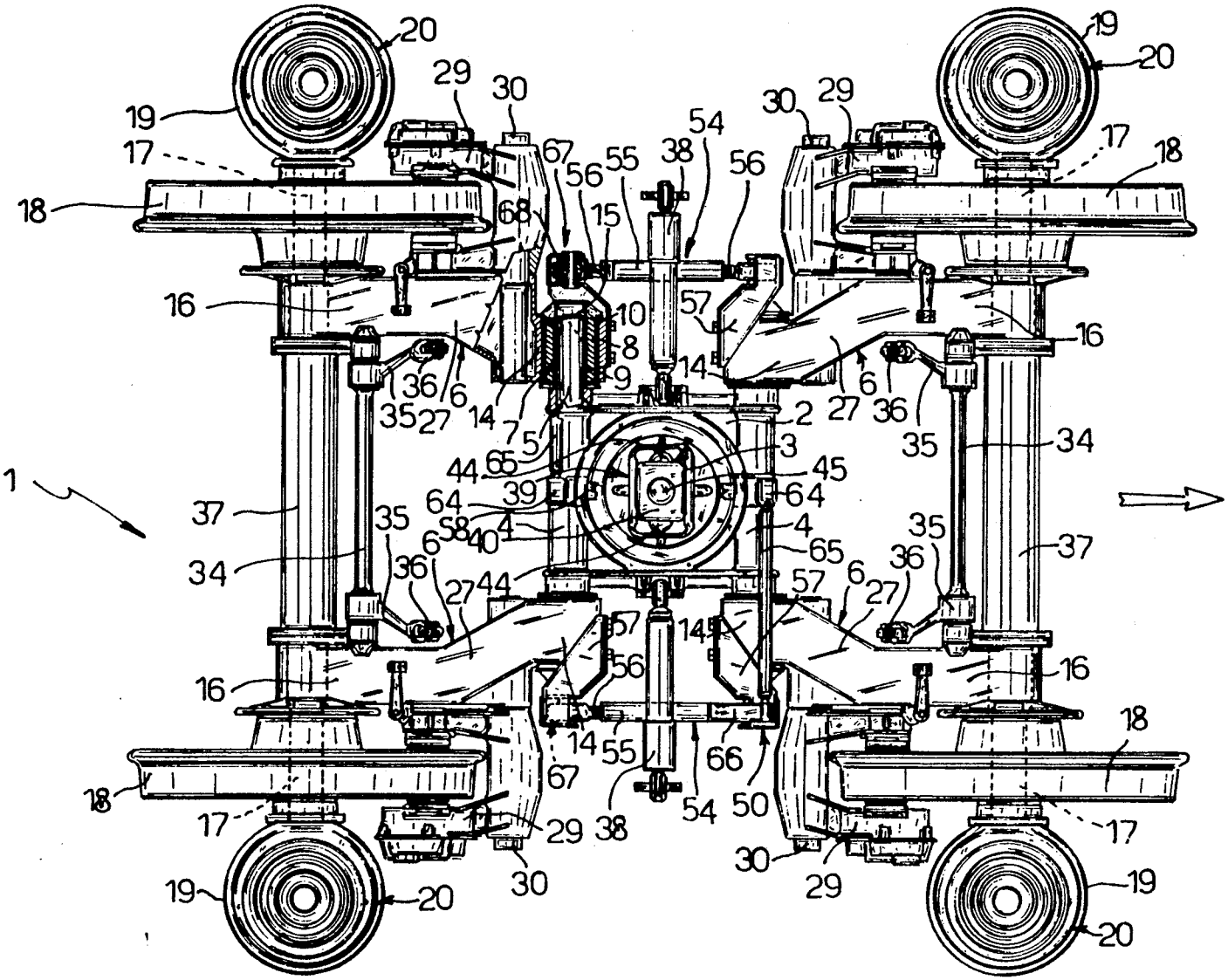
FIG. 1 is a plan view from above of a bogie formed according to the present invention.
Figure 2:
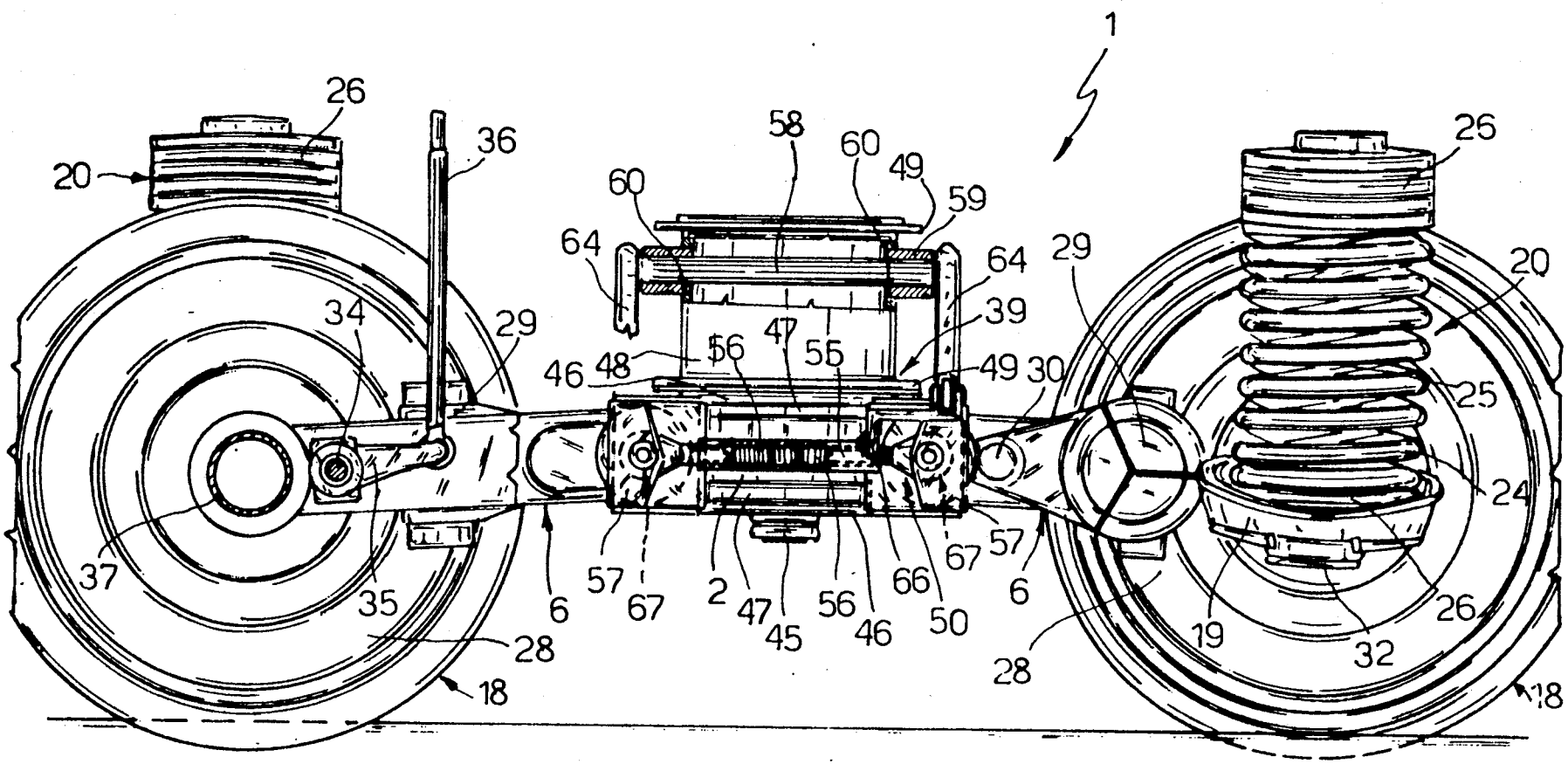
FIG. 2 is a partially sectioned partial side view on an enlarged scale of the bogie of FIG. 1.
Figure 3:
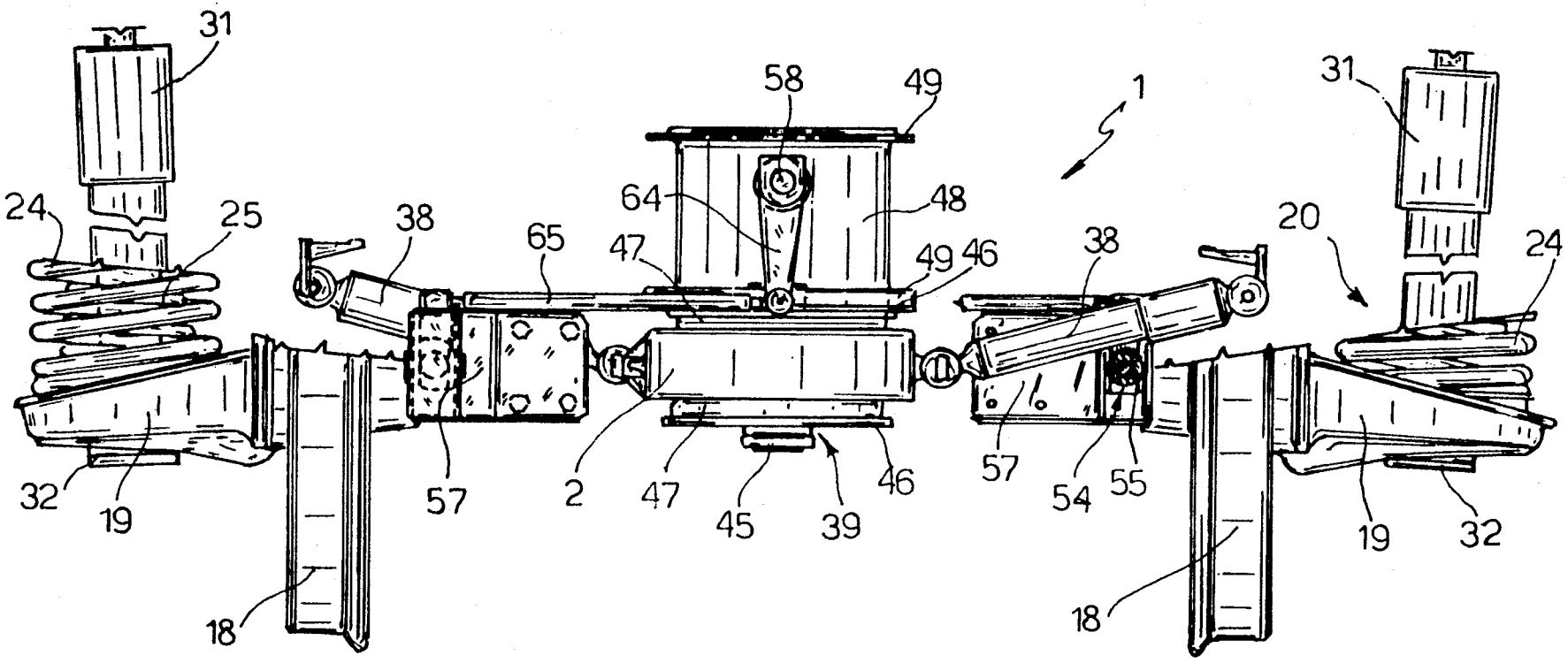
FIG. 3 is a partially sectioned partial rear view on an enlarged scale of the bogie of FIG. 1.

With reference to FIGS. 1, 2 and 3 the reference numeral 1 generally indicates a bogie for a railway vehicle.

The bogie 1 comprises, in a manner known per se, a central support structure 2 and four arms 6 pivoted to it, two on one side and two on an opposite side thereof. The structure 2 has the shape of a substantially square ribbed plate provided with a rectangular central aperture 3 and formed along its front and rear edges with respective tubular supports 4 extending transversely of the bogie 1. Within these supports 4 are housed respective shafts 5 (FIG. 2) opposite end portions of which project out from the supports 4, on which end portions are mounted respective arms 6 with the interposition of resilient bushes 7. These resilient bushes 7, which are of known type, substantially comprise a cylindrical sleeve 8 of elastomeric material vulcanised between an inner sleeve 9 and an outer metal sleeve 10, and are mounted fixedly with respect to the shafts 5 and the arms 6. By virture of the resilient torsional deformability of the sleeves 8 these arms 6 are therefore substantially pivotally fixed to the structure 2 about respective horizontal axes transverse the structure 2, coincident with the axes of the shafts 5; the deformability of the sleeves 8 further allows modest rotations of the arms 6 about a vertical axis to allow self-steering as will be described hereinbelow, and about a horizontal longitudinal axis to allow possible relative movements due to a skew configuration of the rails.

Each arm 6 includes, in particular, an attachment portion 14 provided with a transverse cylindrical seat 15 in which is housed the respective resilient bush 7, an intermediate portion 27 inclined outwardly of the bogie 1 and a longitudinal end portion 16 provided with a transverse cylindrical seat, not illustrated, in which there is mounted rigidly, projecting outwardly of the bogie, an axle 17 of a respective wheel. The wheels 18 are freely rotatably mounted on the respective axles 17 in a conventional manner, not illustrated, for example by means of respective pairs of taper roller bearings. On one end of each axle 17, outside the wheel 18, there is fixed a cup-shape support 19 for a respective suspension unit 20 adapted to be fixed at its upper end to the body of the vehicle. In particular (FIG. 2) this suspension unit 20 includes two coaxial coil springs 24, 25 mounted between resilient annular end buffers 26, and a central shock absorber 31 coaxial with the springs and visible in FIG. 3, connected by ball joints to a central removable portion 32 of the support 9 and adapted to be connected by ball joints to the vehicle body.

Respective brake discs 28 (FIG. 2) are fixed to opposite faces of the wheels 18, on which discs respective brake calipers 29 are adapted to act; these calipers 29 are mounted outside the respective arms 6 and are articulated on pins 30 projecting from the central portions 27 of the arms 6.

The end portions 16 of the front and rear arms 6 are connected transversely together by respective anti-roll bars 34 to which are fixed two short levers 35 articulated at their opposite ends to respective suspension rods 36 linked to the vehicle body. The front and rear arms 6 are further connected together by tubular spacers 37 which ensure the correct gauge upon assembly and in use.

The bogie 1 further includes a pair of shock absorbers 38 articulated to the sides of the support structure 2, which have axes inclined upwardly and outwardly of the bogie and are adapted to be connected at their upper ends to the vehicle body.

The bogie 1 finally includes a coupling element 39 connecting it to the vehicle body, commonly known as a centre casting. The centre casting 39 comprises, in a known way, a prismatic slide block slidably housed within the aperture 3 of the support structure 2 and free to perform with respect to it limited relative translations in a longitudinal sense and translations of relatively greater amplitude in a transverse sense. On the slide block 40 are fixed two resilient lateral buffers 44 serving to absorb the impacts between the slide block 40 and the lateral edges of the aperture 3. Within a vertical cylindrical seat passing through the slide bar 40 is housed a pin 45 on the ends of which are mounted two discs 46 clamped against the slide block 40 and cooperating with opposite faces of the support structure 2 with the interposition of respective resilient elements 47 (FIGS. 2 and 3).

On the upper disc 46 is fixed a cylindrical body 48 coaxial with the pin 45 provided with a flange 49 and adapted to be rigidly connected to the vehicle body. According to the present invention the bogie 1 includes a steering control device generally indicated 50.

The device 50 substantially comprises a pair of linear actuators indicated 54 disposed longitudinally along the sides of the support structure 2 and connecting together the attachment portions 14 of the pair of arms 6 of the respective side of the bogie 1. In particular, these actuators 54 include a cylindrical nut 55 having an internal right hand thread over half its length and a left hand thread for the other half of its length, and a pair of screws 56, respectively right hand and left hand threads, engaging the corresponding threaded portions of the nut 55 and connected at their free ends with respective support brackets 57 projecting outwardly from the attachment portions 14 of the arms 6. In particular the connection between the screws 56 and the brackets 57 is made by means of ball joints 67 including respective resiliently deformable bushes 68 (FIG. 1).

The device 50 further includes a shaft 58 (FIG. 2) housed diametrically in a longitudinal direction within the cylindrical body 48 and supported close to its ends, which project from the cylindrical body 48, by means of a pair of bushes 59 housed in respective holes 60 of the body 48. At the ends of the shaft 58 are rigidly fixed, for example by means of conical tangential pins not illustrated, the upper ends of two vertical levers 64 to the lower ends of which are articulated respective substantially horizontal struts 65 facing opposite sides of the bogie. These struts 65 are articulated at their outer ends to respective substantially L-shape levers 66 and welded at their opposite ends to respective nuts 55.

The operation of the bogie 1 is known per se and is therefore not described in detail. On the other hand the operation of the steering control device 50 will be described hereinafter.

When the railway vehicle proceeds in rectilinear motion the device 50 is in the neutral configuration illustrated in FIG. 1 and does not intervene in any way.

On the other hand, when the vehicle is on a curve general relative motion between the body and the bogie occurs compounded from transverse translation (that is to say substantially radial movement with respect to the path of the rails) due to the centrifugal or centripetal forces acting on the body itself, and rotation about the vertical axis of the centre casting.

The relative lateral translation motion again has no uninfluence on the steering: in fact, it causes a substantially concordant inclination of the levers 64 about their pivots which fix them to the struts 65 and the consequent rotation of the shaft 58 about its axis without any action on the actuators 54.

The relative rotation between the vehicle body and the bogie 1 is converted into a rotation of the shaft 58, carried by the cylindrical body 48 fixed to the vehicle body itself, about the vertical axis of the centre casting 39. This rotation causes on the levers 64 two thrusts in transverse directions of opposite senses; these thrusts are transmitted from the levers 64 to the struts 65 and cause a translation in an axial sense which is converted into a rotation of the respective levers 66 and consequently of the nuts 55 about their axes. These opposite and equal rotations correspond to equal and opposite translations of the screws 56 and, therefore, cause an approaching motion between the arms 6 of one side and a separation between the arms 6 of the other side, allowed by the deformability of the resilient bushes 7. In particular, the arms 6 rotate substantially about the pivot defined by the resilient bushes 7; the axles 17 fixed to the arms 6 consequently turn.

It is evident that the sense of the thread of the screws 56 is chosen in such a way that the device 50 causes a separation of the arms 6 which are on the outside of the curve and an approach of the arms 6 on the inside. More particularly, if the bogie 1 is the front bogie of a vehicle when the direction of movement of the vehicle itself is that indicated with the arrow in FIG. 1, the screws 56 fixed to the rear arms 6 of the bogie (to the left in FIGS. 1 and 2) are right hand threads, whilst those fixed to the front arms (the right in FIGS. 1 and 2) are left hand threads. The senses of the threads must be reversed if the bogie 1 is the rear bogie since the relative rotation with respect to the vehicle body will be opposite.

The pitch of the screws 56 is chosen in such a way that the angle of rotation of the arms 6 is such as to move the axles so as to lie in a perfectly radial direction with respect to the rails. By way of example, for curves of radius equal to 250 metres, normal on railway lines, the required rotation is about 0.0036 rad.

Figure 4:
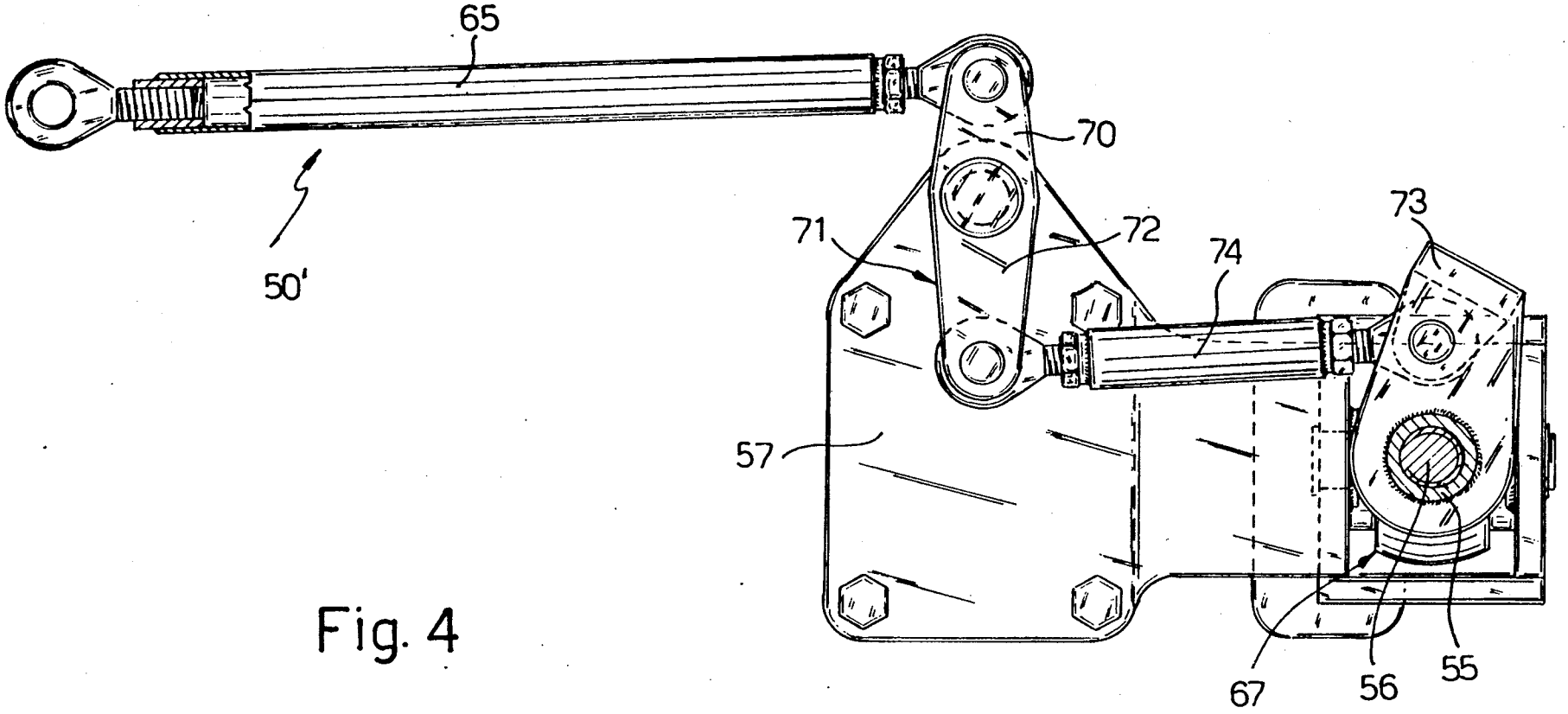
FIG. 4 is a front elevation on a further enlarged scale of a detail of the bogie according to a different embodiment of the present invention.

Generally the choice of the pitch of the screws 56 so that satisfactory radial positioning of the axles 17 is achieved with precision is rather difficult and it is therefore convenient to interpose between the struts 65 and the nuts 55 a suitable transmission mechanism as in the alternative embodiment illustrated in FIG. 4.

In this Figure there is illustrated, limited to the arm actuating members of a single side of the bogie, a device 50' which is described hereinafter only in as much as it differs from the device 50 already described, utilising the same reference numerals to indicate elements which are the same as or correspond to elements already described.

In the device 50' each strut 65 is fixed at one end to a respective lever 54 (not illustrated in FIG. 4) and at its opposite end to an upper arm 70 of a lever 71 pivoted to the bracket 57 and disposed at rest in a substantially orthogonal direction with respect to the strut 65 itself.

A lower arm 72 of the lever 71 is connected by means of a further strut 74 to a fork lever 73 welded onto the nut 55.

In this way it is possible to make a substantially free choice of the pitch of the screws 56; once the pitch is predetermined the amplitude of the rotation of the screw 55 necessary to obtain the required translation of the screws 56 is obtained by suitably dimensioning the arms 70 and 72 of the levers 71.

From a study of the characteristics of the bogie 1 formed according to the present invention the advantages which it allows are evident.

In particular, the device 50 (or 50') ensures the correct steering of the axles, disposing them in a radial direction with respect to the curve of the track. This significantly reduces the wear of the wheels and the rails. The forces transmitted by the linear actuators 54 to the arms 6 are of a relatively low intensity thanks to the deformability of the elastomeric material sleeves 8 of the resilient bushes 7 and to the large leverage which these forces have with respect to the points of articulation of the arms 6. The resilient bushes 68 of the ball joints 67 which connect the screws 56 to the brackets 57 permit possible relative motions between the arms of each side, and in particular skew dispositions of the axles due to irregularities in the rails. It is further observed that as far as external stresses on the arms 6 due to loads on the wheels are concerned, the resilient sleeves 8 and the resilient bushes 68 are parallel to one another and consequently the overall rigidity of the fixing of the arms 6 to the support structure 2 is greater than if the stresses on the arms were imposed by the device 50 (or 50').

A further advantage is given by the configuration of the suspension unit 20 and in particular by the assembly of the shock absorbers 31 coaxial with the springs 24, 25. This in particular allows a rapid dismantling from below of the shock absorbers 31 by removing the central portion 32 of the cup-shape supports 19. Finally it is clear that the bogie 1 can have modifications and variations introduced thereto which do not depart from the protective ambit of the present invention. In particular, the screw and nut actuators 54 can be replaced by fluid pressure actuators controlled by respective valves operated by means for detecting the relative angle between the vehicle body and the bogie, for example lever mechanisms insensitive to relative translations between them, or by electrical actuators operated by similar means.

I claim:

1. A bogie having independent wheels for a railway vehicle, comprising:

a central support structure;

four independent arms carrying respective axles of the wheels;

resilient bushes for respectively articulating said arms to said support structure, two on one side and two on an opposite side, said resilient bushes respectively having horizontal axes extending transversely with respect to said bogie;

suspension means for suspending a body of the vehicle;

a center casting fixed to said support structure with the possibility of relative rotation about its vertical axis and adapted to be fixed rigidly to said vehicle body; and a steering control device for steering said axles, said steering control device including at least one pair of linear actuators disposed longitudinally along the sides of said support structure and connected at their ends to said articulated arms of the corresponding side of said support structure, and means for actuating said linear actuators by a relative rotation between said bogie and said vehicle body, said linear actuators including at least one screw and nut pair means for producing a steering action.

2. A bogie having independent wheels for a railway vehicle, comprising:

a central support structure;

four independent arms carrying respective axles of the wheels;

resilient bushes for respectively articulating said arms to said support structure, two on one side and two on an opposite side, said resilient bushes having respectively horizontal axes extending transversely with respect to said bogie;

suspension means for suspending a body of the vehicle;

a center casting fixed to said support structure with the possibility of relative rotation about its vertical axis and adapted to be fixed rigidly to said vehicle body; and a steering control device for said axles, said steering control device including at least one pair of linear actuators disposed longitudinally along the sides of said support structure and connected at their ends to said articulated arms of the corresponding side of said support structure, and means for actuating said linear actuators by a relative rotation between said bogie and said vehicle body, said linear actuators including a nut and a pair of screws with opposite threads, engaging portions of said nut with corresponding threads and fixed at their free ends to said arms.

3. A bogie according to claim 2, wherein said actuation means include a rotatable element fixed to said center casting with respect to said bogie, and a pair of lever mechanisms connecting said element to associated said nuts and adapted to transform a rotation of said element about said vertical axis into rotations of said nuts about their axes.

4. A bogie according to claim 3, wherein said element is a shaft supported by a body connecting said center casting to said vehicle body; said shaft being rotatable about its longitudinal axis normal to the axis of said center casting and disposed longitudinally with respect to said bogie in the absence of relative rotations between said vehicle body and said bogie.

5. A bogie according to claim 4, wherein said lever mechanisms include a first lever fixed to an associated end of said shaft, a second lever fixed to a respective said nut and at least one transverse strut articulated to said first lever and second lever.

6. A bogie according to claim 2, wherein said screws are connected by means of ball joints to associated brackets fixed to respective said arms.

7. A bogie according to claim 6, wherein said ball joints include respective resiliently deformable bushes.

8. A bogie according to claim 6, wherein said lever mechanisms include transmission means interposed between said strut and at least one of said first and second levers.

9. A bogie according to claim 8, wherein said transmission means include a lever pivoted to said support bracket and articulated with one arm to said strut, and with its opposite arm to a second strut fixed to said second lever.

10. A bogie according to claim 2, wherein said suspension means include four suspension units interposed between respective cup-shape support elements fixed to one end of said axles and said vehicle body; said unit including at least one coil spring and a shock absorber disposed coaxially within said spring and connected by a ball joint to a removable portion of said support element.

* * * * *